US005816895A

United States Patent [19]

Honda

[11] Patent Number: 5,816,895

[45] Date of Patent: Oct. 6, 1998

[54] SURFACE GRINDING METHOD AND APPARATUS

[75] Inventor: Katsuo Honda, Mitaka, Japan

[73] Assignee: Tokyo Seimitsu Co., Ltd., Tokyo, Japan

[21] Appl. No.: 785,487

[22] Filed: Jan. 17, 1997

[51] Int. Cl.[6] ..... B24B 1/00

[52] U.S. Cl. ..... 451/41; 451/5; 451/6; 451/9; 451/10; 451/11; 451/288; 451/380

[58] Field of Search ..... 451/5, 6, 9, 10, 451/11, 285–290, 41, 42, 380

[56] References Cited

U.S. PATENT DOCUMENTS

| | | | |
|---|---|---|---|
| 5,054,244 | 10/1991 | Takamatsu et al. | 451/5 |
| 5,433,650 | 7/1995 | Winebarger | 451/6 |
| 5,433,651 | 7/1995 | Lustig et al. | 451/6 |
| 5,567,199 | 10/1996 | Huber et al. | 451/285 |
| 5,618,447 | 4/1997 | Sandju | 451/5 |
| 5,658,183 | 8/1997 | Sandhu et al. | 451/6 |

FOREIGN PATENT DOCUMENTS 8170912 7/1996 Japan .

*Primary Examiner*—Robert A. Rose
*Assistant Examiner*—George Nguyen
*Attorney, Agent, or Firm*—Sixbey, Friedman, Leedom & Ferguson; David S. Safran

[57] ABSTRACT

A semiconductor wafer is placed on a table, and a grinding wheel grinds the surface of the semiconductor wafer. Non-contact sensors are arranged above the semiconductor wafer to detect the thickness of the semiconductor wafer during grinding. Each piece of information relating to the thickness is output to a CPU. Piezoelectric devices are arranged at regular intervals between a flange, which is secured to a grinding wheel spindle, and a frame 40. Voltages applied to the piezoelectric devices are controlled by a piezoelectric device controller which is controlled by the CPU. When the piezoelectric devices are driven, the attitude of the grinding wheel spindle is controlled in such a manner as to be rocked with regard to the table. If the CPU calculates the detected values of the sensors during the grinding, the direction and magnitude of inclination of the table and the grinding wheel spindle can be found. Then, the attitude of the grinding wheel spindle is controlled, so that the surface of the semiconductor wafer can be ground to be flat.

6 Claims, 6 Drawing Sheets

$H_A > H_B > H_C$ $H_A > H_C > H_B$ $H_C > H_B > H_A$

SURFACE GRINDING METHOD AND APPARATUS

BACKGROUND OF THE INVENTION

1. Field of the Invention

The present invention relates to a surface grinding method and apparatus. More particularly, the present invention relates to a surface grinding method and apparatus for a semiconductor wafer, a hard disk, etc.

2. Description of the Related Art

A surface grinding apparatus grinds the surface of a wafer sliced by a slicing machine in an after-processing. In the surface grinding apparatus, the wafer is placed on a chuck table, and the parallelism between the surface of the wafer and the grinding wheel is adjusted. The surface of the wafer is ground in such a manner that the grinding wheel is pressed against the surface of the wafer while the grinding wheel is rotating, so that the surface of the wafer can be ground.

In order to cope with circuit patterns which have been highly integrated, the flatness and parallelism of the surface of the wafer must be accurate.

In the conventional surface grinding apparatus, however, the parallelism between the surface of the wafer and the grinding wheel deteriorates due to changes in temperature of atmosphere and machining solution during the grinding, or the deflection of the grinding wheel, etc. Thus, there is a disadvantage in that the flatness and parallelism of the ground surface of the wafer deteriorate.

SUMMARY OF THE INVENTION

The present invention has been developed in view of the above-described circumstances, and has as its object the provision of a surface grinding method and apparatus which can improve the flatness and parallelism of a workpiece.

In order to achieve the above-mentioned object, the present invention provides a surface grinding method, in which a rotating grinding wheel is pressed against a surface of a workpiece placed on a workpiece supporting table to grind the surface of the workpiece, characterized in that the thickness of the workpiece is measured at more than three positions during grinding, and the attitude of the workpiece supporting table and/or the grinding wheel is controlled so that each of the measured thickness at plural positions can be a predetermined value, and thereby the surface of the workpiece can be ground.

Moreover, in order to achieve the above-mentioned object, the present invention provides a surface grinding apparatus, which presses a rotating grinding wheel against the surface of a workpiece mounted on a workpiece supporting table, and which is characterized by having more than three measuring means for measuring the thickness of the workpiece during grinding, and a control means for controlling an attitude of the workpiece supporting table and/or the grinding wheel so that the thickness measured by the measuring means at a plurality of positions can be a predetermined value.

According to the present invention, the workpiece is mounted on the workpiece supporting table, and then the rotating grinding wheel is pressed against the workpiece to start grinding the surface of the workpiece. Then, a plurality of measuring means measures the thickness of the workpiece at three positions during grinding. Next, the control means controls the attitude of the workpiece supporting table and/or the grinding wheel so that each of the thickness measured by the measuring means at plural positions can be a predetermined value.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 1 is a view illustrating the structure of essential parts of a wafer surface grinding machine which a surface grinding machine of the present invention applies to;

DETAILED DESCRIPTION OF THE PREFERRED EMBODIMENTS

Figure 1:
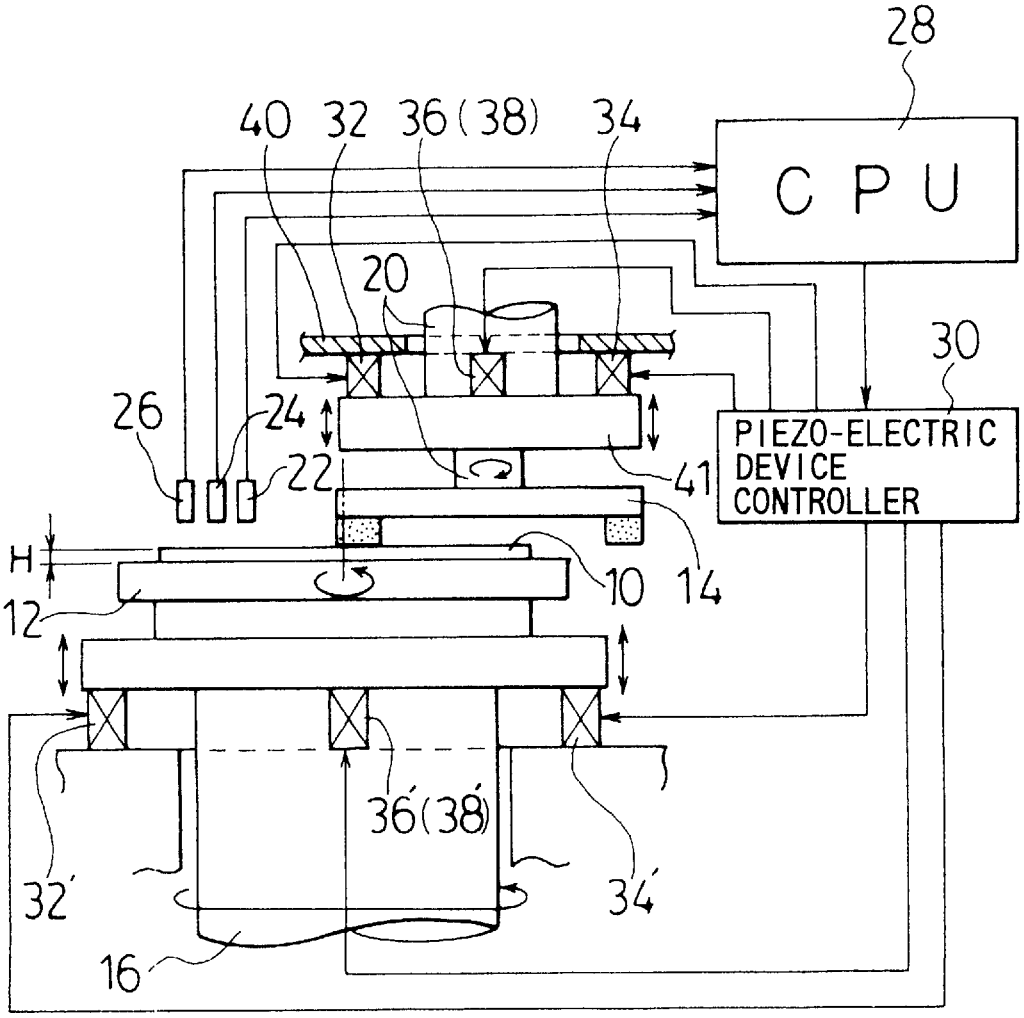

FIG. 1 is a view illustrating the structure of an embodiment in which a surface grinding apparatus according to the present invention is applied to a wafer surface grinding apparatus. The surface grinding apparatus shown in FIG. 1 is provided with a table 12 for supporting a semiconductor wafer 10, and a grinding wheel 14 for grinding the surface of the semiconductor wafer 10. A spindle 16 connects to the face of the table 12, and a motor (not shown) connects to the spindle 16. The rotational force of the motor is transmitted to the table 12 via the spindle 16 so that the table 12 can rotate.

The cup-shaped grinding wheel 14 is secured to the bottom of a grinding wheel axis 20. The grinding wheel axis 20 connects to a motor (not shown) and a lifting apparatus (not shown). The grinding wheel 14 is rotated by the motor and is lowered by a lifting mechanism. The grinding wheel 14 is pressed against the surface of the semiconductor wafer 10, and when the table 12 rotates, the surface of the semiconductor wafer is ground.

Figure 2:
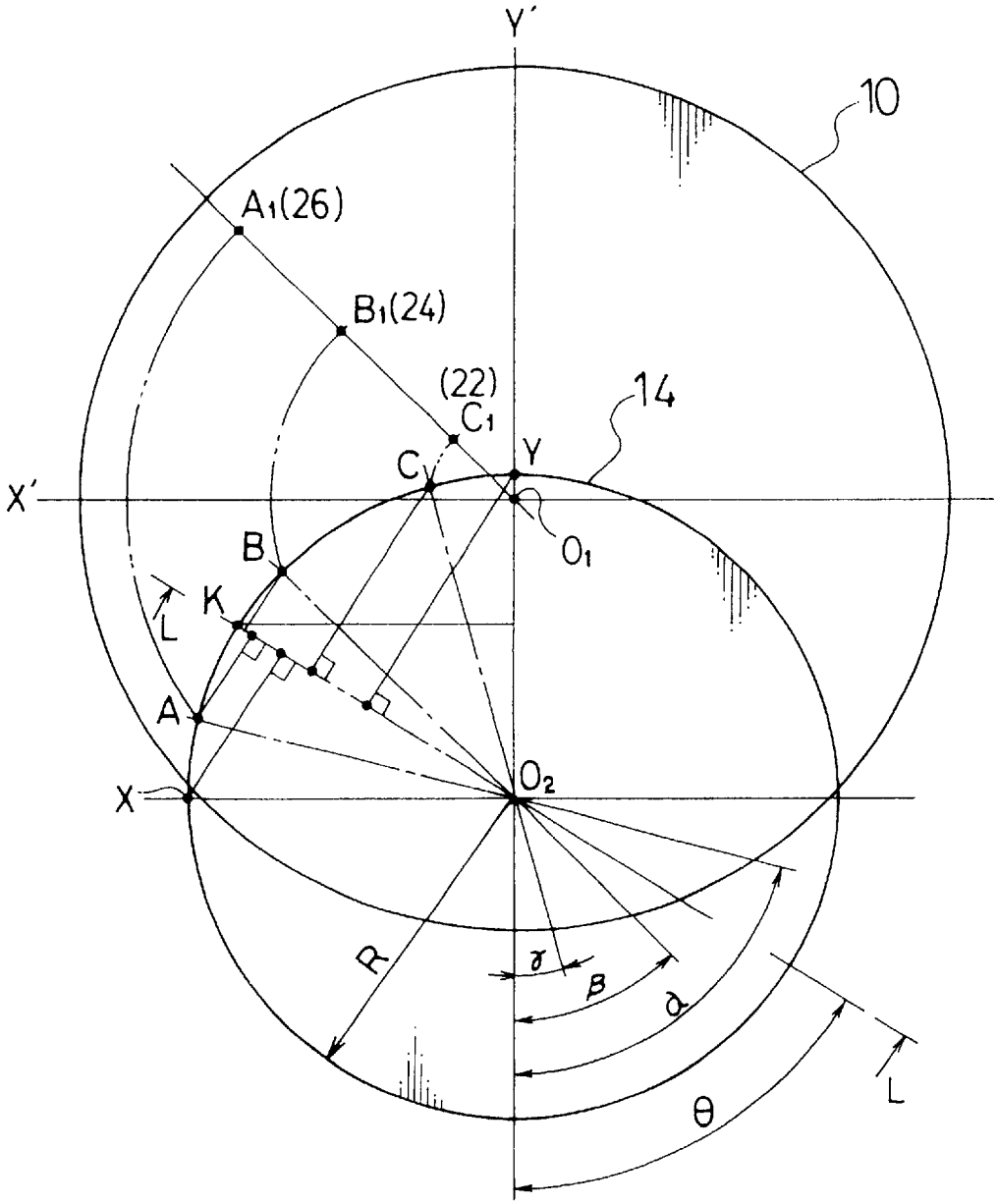
FIG. 2 is a conceptional view showing a positional relationship between a semiconductor wafer and a grinding wheel.

Three non-contact sensors 22, 24, and 26 are arranged above the semiconductor wafer 10. These sensors 22, 24, and 26 detect the thickness H of the semiconductor wafer 10 during the grinding, and they are arranged at predetermined intervals in the direction of the radius as shown in FIG. 2. Each piece of the thickness information, which is detected by the non-contact sensors 22, 24, and 26, is output to a central processing unit (CPU) 28. The CPU 28 controls a piezo-electric device controller 30 based upon the thickness information so as to control the attitude of the grinding wheel axis 20. How to control the attitude of the grinding wheel axis 20 will be explained later.

On the other hand, four piezo-electric devices 32, 34, 36 and 38 are arranged between a plate-shaped flange 41, which is secured to the grinding wheel axis 20, and a frame 40 (the piezo-electric device 38 faces the piezo-electric device 36 in the direction of the diameter). The piezo-electric devices 32, 34, 36, and 38 are arranged at regular intervals every 90°. When the voltage is applied to these devices by the piezo-electric device controller 30, they can be driven in upward and downward directions in the drawing. Thus, if the piezo-electric devices 32, 34, 36, and 38 are driven, the grinding wheel axis 20 rocks with regard to the frame 40, and its attitude is controlled. Thereby, if each voltage applied to the piezo-electric devices 32, 34, 36, and 38 is controlled, the squareness of the semiconductor wafer 10 with regard to the grinding wheel axis 20 can be acquired.

Next, an explanation will be given about how the CPU 28 controls the attitude of the table 12.

Figure 9:
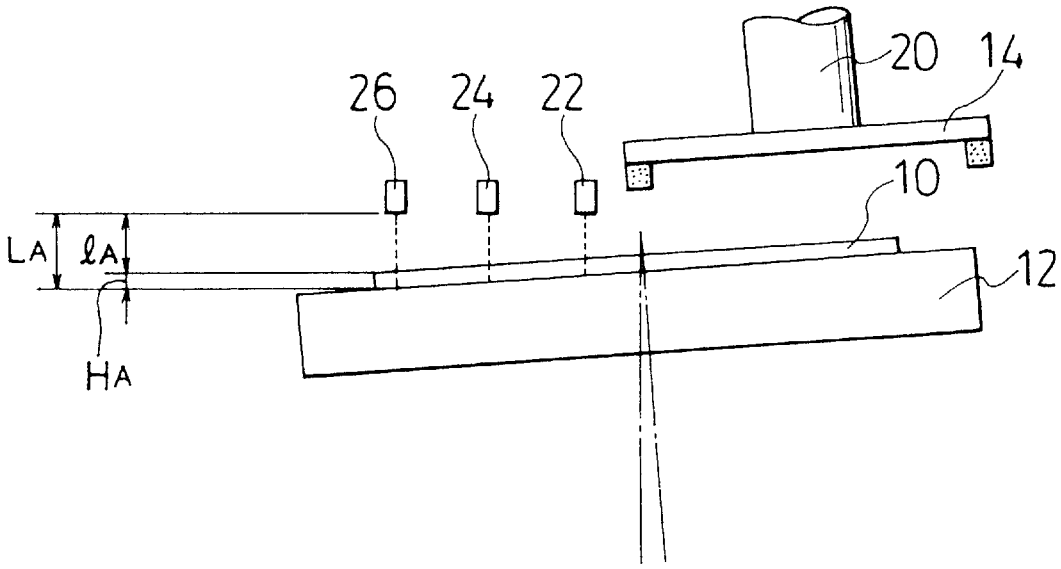
FIG. 9 is a view showing the case when the thickness of a semiconductor wafer is detected.

Distances between $l_A$, $l_H$ and $l_C$ between non-contact sensors 22, 24, and 26 in FIG. 9 and the adsorbing section of the table 12 are subtracted from distances $L_A$, $L_H$ and $L_C$ between non-contact sensors 22, 24 and 26 and an adsorbing section of the table 12. The subtracted values are regarded as the thickness $H_A$, $H_H$ and $H_C$ of the semiconductor wafer 10. The CPU 28 controls the piezo-electric device controller 30 based upon the thickness $H_A$, $H_H$ and $H_C$. If the thickness of the semiconductor wafer is equal, and the surface is completely flat, the thickness $H_A$, $H_H$ and $H_C$ are equal at the three positions.

Next, an attitude controlling method will be explained with reference to FIG. 2 showing the semiconductor wafer 10 and the grinding wheel 14.

FIG. 2 is a view showing a positional relationship between the semiconductor wafer 10 and the grinding wheel 14. A circle with a larger diameter is the semiconductor wafer 10, and a circle with a smaller diameter is a grinding wheel 14. A point $O_1$ in FIG. 2 is a rotational center of the semiconductor wafer 10 (the table 12), and $O_2$ is an axis of the grinding wheel spindle 20.

Three non-contact sensors 22, 24 and 26 are arranged at points $C_1$, $B_1$ and $A_1$, respectively, in FIG. 2. The thickness of the semiconductor wafer 10 at these points are $H_C$, $H_B$ and $H_A$ as stated previously.

Points A, B and C in FIG. 2 are cocentrical with points $A_1$, $B_1$ and $C_1$ around a center $O_1$ of the table 12. The thickness of the semiconductor wafer 10 at A, B and C are $H_A$, $H_B$ and $H_C$.

The thickness of the grinding wheel at X and Y on the X=axis and the Y=axis are supposed to be $H_X$ and $H_Y$, and the lowest point when the grinding wheel 14 is inclined is referred to as a point K, and the thickness at the point K is supposed to be $H_K$.

Figure 3:
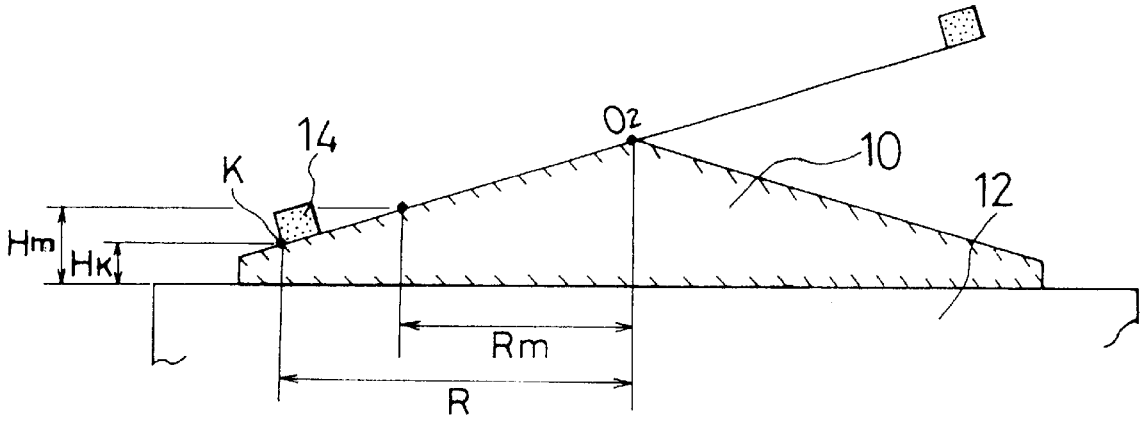
FIG. 3 is a view in the direction of the line L—L in FIG. 2.

The thickness Hm of the wafer at an optional point Rm on a segment $O_2K$ as shown in FIG. 3.

Hm is defined as $Hm=(H_K/R)Rm$; thus, the thickness $H_A$, $H_B$ and $H_C$ at points A, B and C are equal to the thickness at points of intersection of perpendicular lines from A, B and C to the segment $O_2K$. Thus, if Rm in $Hm=(H_K/R)Rm$ is selected, the thickness of each point of intersection can be found.

Figure 4:
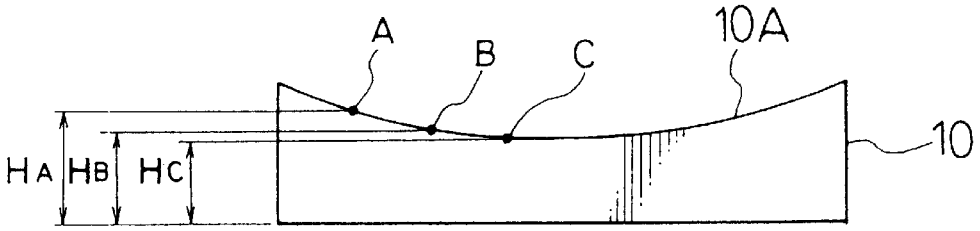
FIG. 4 is a view showing the thickness of a semiconductor wafer obtained from a sensor.

If the point K corresponds to the point Y in FIG. 2 (that is, if the point Y is the lowest), the sectional shape of the semiconductor wafer 10 is as shown in FIG. 4, and $H_A>H_B>H_C$.

Figure 5:
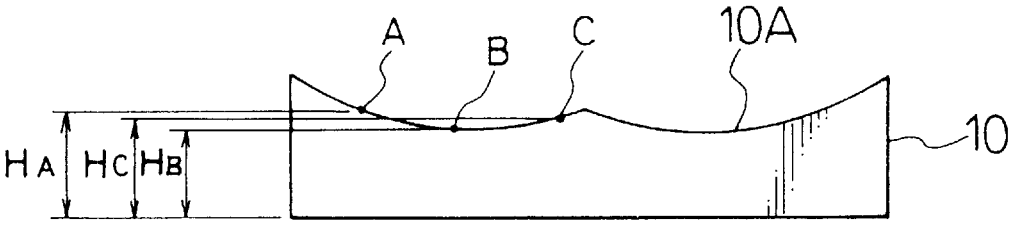
FIG. 5 is a view showing the thickness of a semiconductor wafer.

If an angle θ at the point K is between (α+β)/2 and (β+γ)/2 (that is, the lowest point is between (α+β)/2 and (β+γ)/2, the shape of the semiconductor wafer 12 is as shown in FIG. 5, and $H_A>H_C>H_B$.

Figure 6:
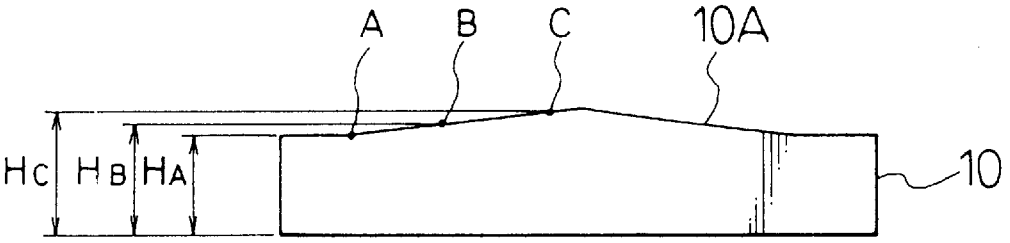
FIG. 6 is a view showing the thickness of a semiconductor wafer.

If the angle θ at the point K is more than (α+β)/2, the shape of the semiconductor wafer 10 is as shown in FIG. 6, and $H_C>H_B>H_A$.

Figure 7:
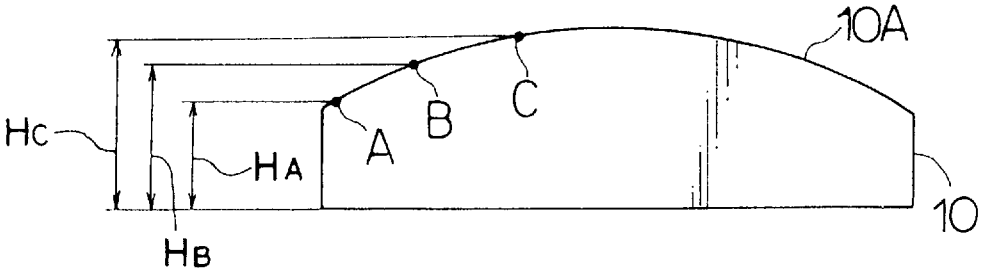
FIG. 7 is a view showing the thickness of a semiconductor wafer.

If the point K is at the opposite of Y (if the point Y is the highest), the sectional shape of the semiconductor wafer 10 is as shown in FIG. 7, and $H_C>H_B>H_A$.

That is, the shape of the semiconductor wafer 10 during grinding can be found by determining which is the largest among $H_A$, $H_B$ and $H_C$. The CPU 28 calculates the values of $H_A$, $H_B$ and $H_C$ so as to find the phase and extent of the change in the squareness of the grinding wheel spindle 20 and the table 12 can be found.

In FIG. 2, $$H_K=\sqrt{(H_X^2+H_Y^2)}$$

$$H_A=H_K \cos(\theta-\alpha)$$

$$H_B=H_K \cos(\theta-\beta)$$

$$H_C=H_K \cos(\theta-\gamma)$$

$$H_X=H_K \sin\theta$$

$$H_Y=H_K \cos\theta$$

$$\tan\theta=H_X/H_Y$$

The following equations can be formed.

$$\tan\theta=-[(H_B-H_C)\cos\alpha+(H_C-H_A)\cos\beta+(H_A-H_B)\cos\gamma]/[(H_B-H_C)\sin\alpha+(H_C-H_A)\sin\beta+(H_A-H_B)\sin\gamma]$$

$$H_K=(H_A-H_B)/[\cos(\theta-\alpha)-\cos(\theta-\beta)]$$

$$H_X=H_K \sin\theta$$

$$H_Y=H_K \cos\theta$$

Thus, the phase angle θ and the thickness $H_K$, $H_X$, and $H_Y$ at the lowest point can be found in view of the difference between the thickness at points A, B and C during the grinding. The squareness can be corrected by rocking the grinding wheel spindle 20 by $-H_X$ in the direction of X and $-H_Y$ in the direction of Y. Thus, the CPU 28 controls the voltage applied to the piezo-electric devices 32, 33, 34, 35, 36, 37 and 38 so that the grinding wheel spindle 20 can be inclined by $-H_X$ in the direction of X and $-H_Y$ in the direction of Y. Thereby, the attitude of the grinding wheel spindle 20 is controlled with regard to the grinding surface of the semiconductor wafer 10 during the grinding, so that the surface of the semiconductor wafer 10 can be ground to be flat.

In this embodiment, the piezo-electric devices 32, 34, 36 and 38 are provided at the grinding wheel spindle 20, so that the attitude of the grinding wheel 14 can be controlled. As shown in FIG. 1, however, piezo-electric devices 32', 34', 36' and 38' may be provided at the table 12, and the piezo-electric devices may be provided at both the table 12 and the grinding wheel 14, so that the attitude of both the table 12 and the grinding wheel 14 can be controlled.

In this embodiment, the non-contact sensors 22, 24 and 26 are used as measuring means; however, the measuring means may be contact sensors, and the number of sensors is more than three.

Moreover, in this embodiment, the explanation is given about the surface grinding machine for the semiconductor wafer; however, the present invention may be applied to a surface grinder for other plate-shaped materials.

Figure 8:
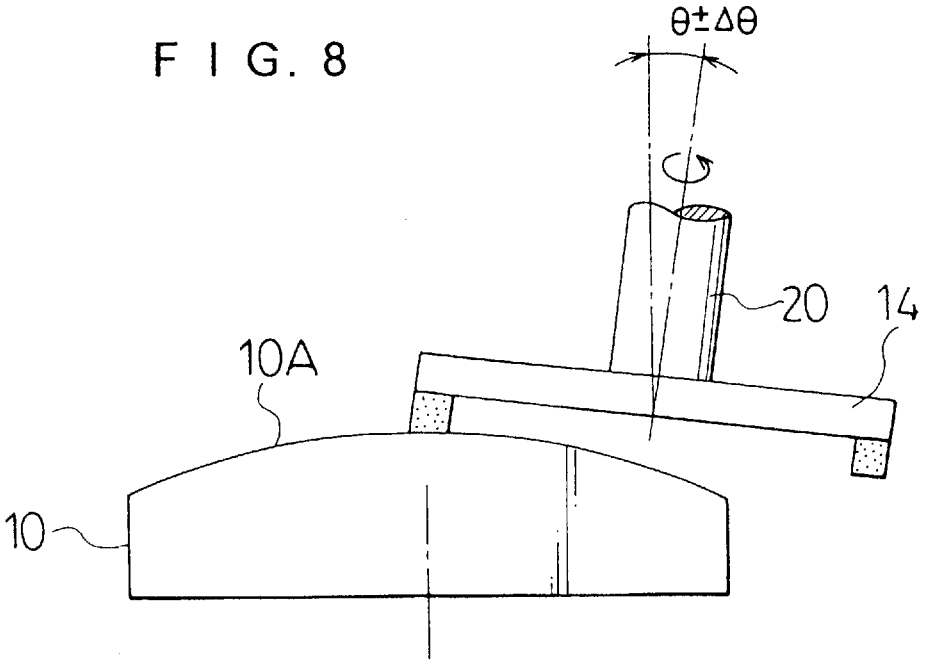
FIG. 8 is a view showing the case when a semiconductor wafer is ground to be round.

Furthermore, in this embodiment, the explanation is given about the control of the grinding wheel spindle for grinding the surface of the workpiece to be flat; however, the present invention is not restricted to this. The thickness of the workpiece is determined to be as predetermined, so that the surface 10A of the wafer can be ground to be round as shown in FIG. 8. In this case, an angle of $\theta \pm \Delta\theta°$ of the grinding wheel spindle 20 is determined to correspond to the curvature of the surface 10A of the wafer.

In this embodiment, the non-contact sensors 22, 24 and 26 of this embodiment compose the measuring means of the present invention, and the CPU 28, the piezo-electric device controller 30, and the piezo-electric devices 32, 34, 36 and 38 compose the control means of the present invention.

As set forth hereinabove, according to the surface grinding method and apparatus of the present invention, the thickness of the workpiece is measured at a plurality of positions during the grinding, and the attitude of the table and/or the grinding wheel is controlled so that the thickness of the workpiece at a plurality of positions can be as predetermined. Thereby, the flatness and parallelism of the surface of the workpiece can be improved.

It should be understood, however, that there is no intention to limit the invention to the specific forms disclosed, but on the contrary, the invention is to cover all modifications, alternate constructions and equivalents falling within the spirit and scope of the invention as expressed in the appended claims.

I claim:

1. A surface grinding method, in which a rotating grinding wheel is pressed against a surface of a workpiece mounted on a workpiece supporting table so that the surface of said workpiece can be ground, comprising the steps of:

grinding the surface of said workpiece by producing relative movement between said grinding wheel and said workpiece, measuring the thickness of said workpiece during grinding, controlling the orientation of at least one of said workpiece supporting table and said grinding wheel so that said relative movement produces a predetermined value of the measured thickness of the workpiece at each of a plurality of positions along the surface of the workpiece.

2. Surface grinding apparatus having a body comprising:

a workpiece supporting table having a workpiece supporting section for supporting a workpiece relative to said body;

a grinding wheel having a grinding face abutted against said workpiece supported by said workpiece supporting table and rotated to grind a surface for said workpiece;

more than three measuring means for measuring thickness of said workpiece being ground;

driving means for making variable an orientation of at least one of said workpiece supporting table and said grinding wheel; and control means for controlling said driving means so as to make variable an orientation of said workpiece supporting table and/or said grinding wheel by controlling said driving means so that thickness at a plurality of positions of said workpiece measured by said measuring means can be a predetermined value.

3. Surface grinding apparatus according to claim 2, wherein said measuring means comprises:

a plurality of non-contact sensors for measuring a distance between said workpiece and the grinding face, said plurality of non-contact sensors being located at a distance from the workpiece supporting section of said workpiece supporting table; and calculating means for calculating a thickness of said workpiece by subtracting said distance between said workpiece and the grinding face measured by said plurality of non-contact sensors from the distance between said plurality of non-contact sensors and the workpiece supporting section of said workpiece supporting table.

4. The surface grinding apparatus as defined in claim 2, wherein said driving means is piezoelectric devices.

5. The surface grinding apparatus as defined in claim 4, wherein a plurality of said piezoelectric devices are provided between said workpiece supporting table and the body of said surface grinding apparatus.

6. Surface grinding apparatus according to claim 4, wherein a base is provided for supporting the piezoelectric devices; wherein said grinding wheel comprises a grinding element mounted for rotation on a spindle having a flange; and wherein said piezoelectric devices are arranged between said flange of the spindle of the grinding wheel and the base.

* * * * *